US008918958B1

(12) United States Patent
Carreon et al.

(10) Patent No.: US 8,918,958 B1
(45) Date of Patent: Dec. 30, 2014

(54) CLIP-ON DOOR STOP

(71) Applicants: Jose Guadalupe Carreon, Conroe, TX (US); Hector Andres Villarreal, Houston, TX (US)

(72) Inventors: Jose Guadalupe Carreon, Conroe, TX (US); Hector Andres Villarreal, Houston, TX (US)

( * ) Notice: Subject to any disclaimer, the term of this patent is extended or adjusted under 35 U.S.C. 154(b) by 0 days.

(21) Appl. No.: 14/311,801

(22) Filed: Jun. 23, 2014

Related U.S. Application Data

(63) Continuation-in-part of application No. 14/164,436, filed on Jan. 27, 2014, now abandoned.

(51) Int. Cl.
*E05F 5/02* (2006.01)
*E05F 5/00* (2006.01)

(52) U.S. Cl.
CPC ..... *E05F 5/00* (2013.01)
USPC ..... 16/86 R; 16/82

(58) Field of Classification Search
USPC ..... 16/49, 82, 85, 86 R, 86 A; 292/338, 339
See application file for complete search history.

(56) References Cited

U.S. PATENT DOCUMENTS

| | | | | | |
|---|---|---|---|---|---|
| 2,704,220 | A * | 3/1955 | Graham | 292/338 |
| 2,709,615 | A * | 5/1955 | Barnes, Jr. et al. | 292/339 |
| 3,731,341 | A * | 5/1973 | Woodruff | 16/82 |
| 4,673,203 | A * | 6/1987 | Chezem | 292/339 |
| 4,890,092 | A * | 12/1989 | Grimm | 340/546 |
| 5,335,396 | A * | 8/1994 | Dolan | 16/82 |
| 5,673,952 | A * | 10/1997 | Chezem et al. | 292/338 |
| 7,065,830 | B2 * | 6/2006 | Bushey | 16/82 |
| 7,559,114 | B2 * | 7/2009 | Ranilovich | 16/82 |
| 7,690,080 | B1 * | 4/2010 | Coffman, II | 16/82 |
| 2005/0229358 | A1 * | 10/2005 | Barone | 16/82 |
| 2012/0272482 | A1 * | 11/2012 | Evans | 16/86 R |

* cited by examiner

*Primary Examiner* — William Miller
(74) *Attorney, Agent, or Firm* — John Timothy Headley

(57) ABSTRACT

A door stop comprises a flexible bar having a first end, a second end, and six sequential adjacent bends between the first and second ends, the first sequential adjacent bend closest to the first end, and the sixth sequential adjacent bend closet to the second end. A rubber grommet is affixed into the first end, and protrudes past the first end. A hole in the second end is substantially three-sixteenth inch in diameter. The distance between the fifth and sixth sequential adjacent bends is substantially equal to 1.375 inches. In an alternate embodiment, the distance between the fifth and sixth sequential adjacent bends is substantially equal to 1.75 inches.

12 Claims, 2 Drawing Sheets

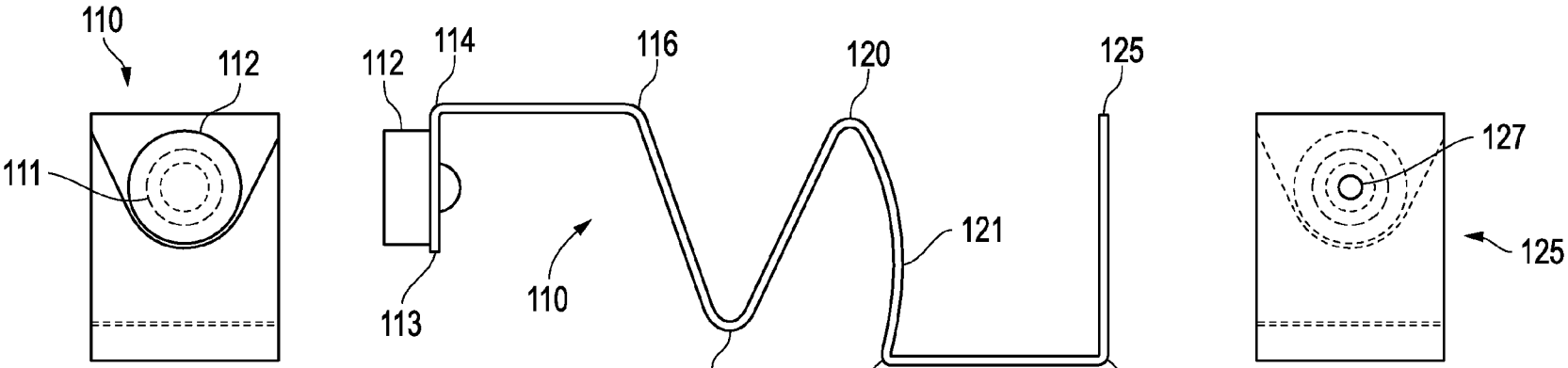
FIG. 1A
FIG. 1B
FIG. 1C
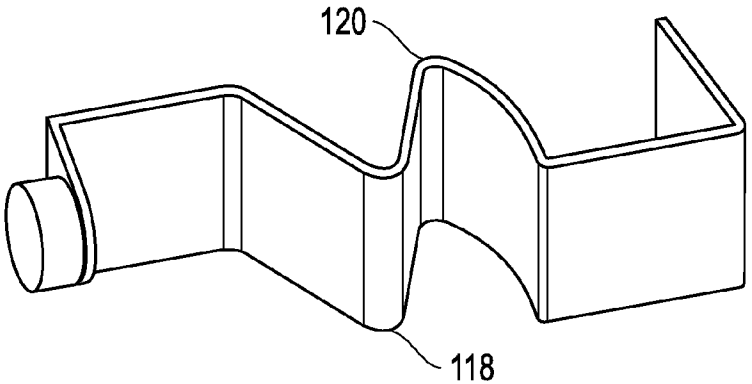
FIG. 1D

CLIP-ON DOOR STOP

CROSS-REFERENCE TO RELATED APPLICATIONS

This patent application is a continuation-in-part of patent application Ser. No. 14/164,436, filed Jan. 27, 2014, now abandoned.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION (1) Field of the Invention

The invention relates to fixed or moveable closures for openings in buildings, and more particularly, to stops for doors.

(2) Description of Related Art (Including Information Disclosed Under 37 CFR 1.97 and 1.98)

Most existing door stops require the user to fasten them to the floor board or to the door itself with a fastener, such as with screws, nails, etc. Such prior art door stops thus require the user to use tools such as a screwdriver, a drill, a hammer, etc. Most existing door stops are also specific to where they must be installed and fastened.

In light of the foregoing, a need remains for a door stop to protect the nearby wall from damage, that (a) can easily be installed by anyone on any outer edge of standard size doors (inner and outer doors) without having to fasten the door stop with fasteners, such as screws, nails, etc., and (b) can be clipped on any outer edge side of a door, thus allowing a person to adjust the door stop to the area of impact of choice.

BRIEF SUMMARY OF THE INVENTION

A door stop comprises a flexible bar having a first end, a second end, and six bends between the first and second ends, the first bend closest to the first end, and the sixth bend closet to the second end. A rubber grommet is affixed into the first end, and protrudes past the first end. A hole in the second end is substantially three-sixteenth inch in diameter. The distance between the fifth and sixth sequential adjacent bends is substantially equal to 1.375 inches. In an alternate embodiment, the distance between the fifth and sixth sequential adjacent bends is substantially equal to 1.75 inches.

BRIEF DESCRIPTION OF THE SEVERAL VIEWS OF THE DRAWINGS

The novel features characteristic of the invention are set forth in the appended claims. However, the invention itself, as well as a preferred mode of use, and further objectives and advantages thereof, will best be understood by reference to the following detailed description, when read in conjunction with the accompanying drawings in which the left-most significant digit(s) in the reference numerals denote(s) the first figure in which the respective reference numerals appear.

FIG. 1A is a view of a first end of the clip-on door stop, showing the end of a rubber bumper grommet, attached on the first end of the clip-on door stop.

FIG. 1B is a side view of the clip-on door top, illustrating the clip, spring, and grommet.

FIG. 1C is a view of a second end of the clip-on door stop, showing the hole for use with an optional fastener.

FIG. 1D is a perspective view of the clip-on door stop.

DETAILED DESCRIPTION OF THE INVENTION

Figure 2:
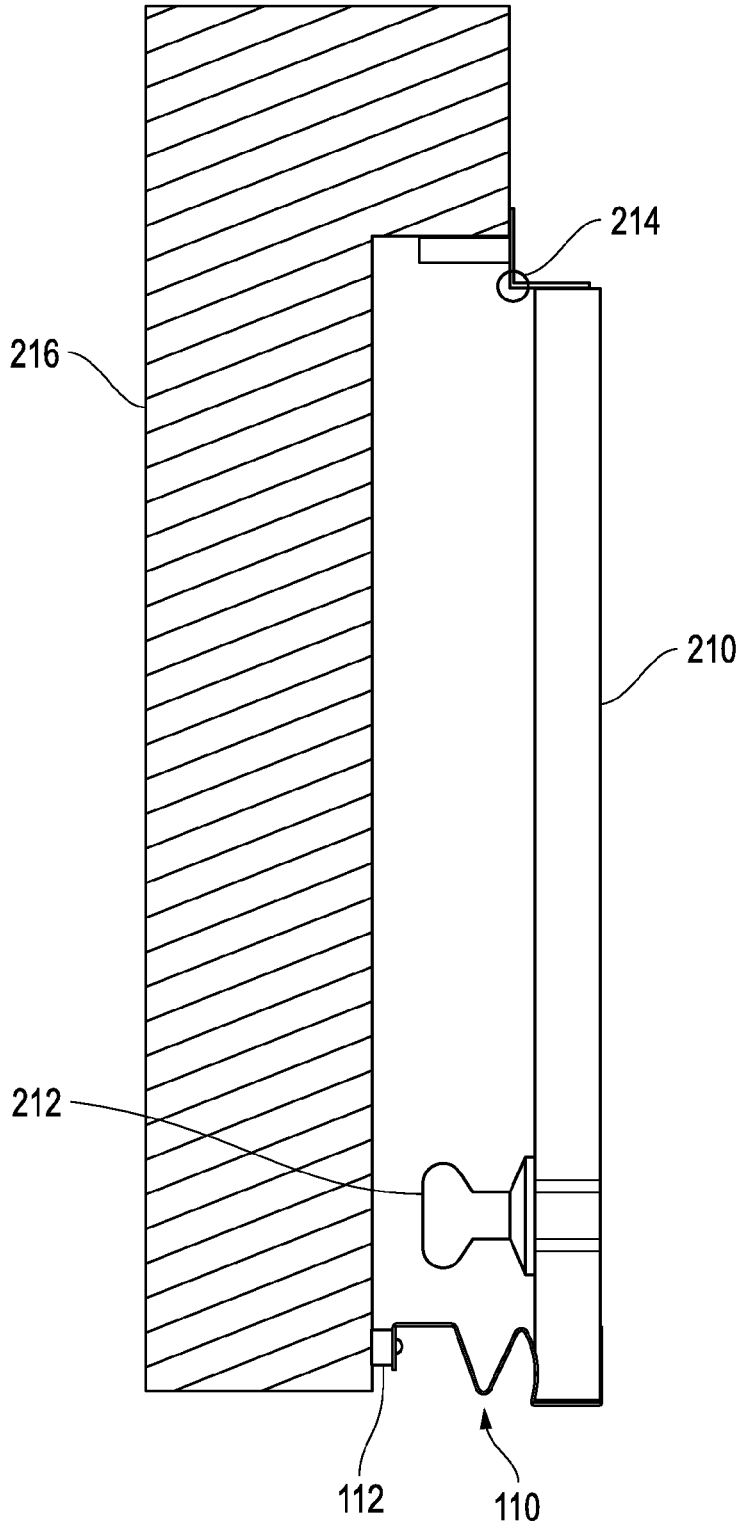
FIG. 2 is a top view of a door with the clip-on door stop attached with a rubber grommet.

Referring now to FIG. 1A, in the preferred embodiment, a clip-on door stop 110 is 1.25 inches wide, and 1.6 inches high. A hole 111 receives in a compression fit a tip of a circular rubber grommet 112 in a first end 113, which has an outside diameter of one inch, and is one-half inch thick. The rubber is preferably a semi-soft rubber. The grommet is preferably Model No. MRB, manufactured by the Miller Rubber company, located in Durham, N.C. The grommet 112 is attached at a first end 113.

Referring now to FIG. 1B, the clip-on door stop 110 includes six bends 114, 116, 118, 120, 122, and 124 along its length. The bends 114 and 124 are ninety-degree bends. The bend 116 forms an angle greater than ninety degrees, and the bends 118, 120, and 122 form angles less than ninety degrees. The six bends give the door stop 110 sufficient flexibility to withstand the force created by a forceful thrust of a door by an adult male. The bends 122 and 124, together with a slight curvature between bends 120 and 122, act as a clip to create sufficient tension so that the door stop 110 can be clipped to any standard sized door (whether an interior door or an exterior door), between the bends 122 and 124. The distance from the bend 122 to the bend 124 is 1.375 inches, which is currently the thickness of a standard interior door. In an alternate embodiment, the distance from the bend 122 to the bend 124 is 1.75 inches, which is currently the thickness of a standard exterior door.

A midpoint 121 between the bends 120 and 122, is spaced 1.278 inches from a second end 125, which distance is slightly less than the current thickness of a standard interior door, which is 1.375 inches. In an alternate embodiment, the midpoint 121 is spaced approximately 1.653 inches from the second end 125, which distance is slightly less than the current thickness of a standard exterior door, which is 1.75 inches.

The distance from the first end 113 to the second end 125 is five inches. In the preferred embodiment, the door stop 110 is made of 0.029 inch thick stainless steel, but can also be made of steel, iron, tin, aluminum, or a flexible plastic, such as Polyurethane, sold by the Coastal Plastics company, located in Alvin, Tex.

Referring now to FIG. 1C, the end 125 of the door stop 110 contains a hole 127, that can be used to permanently fasten the door stop 110 to a door. The hole 127 has a diameter of three-sixteenths (3/16) inch, which is sized to receive a standard size #8 wood screw.

Referring now to FIG. 1D, the radius of the circle of the bend 118 is 0.155 inches, and the radius of the circle of the bend 120 is 0.125 inches.

Referring now to FIG. 2, the door stop 110 is illustrated as installed on a standard door 210, looking down from a ceiling of a room. As shown, the door stop 110 is attached to a side of the door 210 above a door knob 212, and on the opposite side of the door 210 from door hinges 214, but the door stop could also be attached below the door knob 212, or on the top of the door 210. As shown, the rubber grommet 112 is contacting a wall 216, thus preventing the door knob 212 from banging against the wall 216.

In operation, a user can quickly and easily attach the door stop 110 to any location on the door 210, without the use of any tools. However, if desired, a user may use a fastener to attach the door stop 110 to the door 210, through the hole 127.

What is claimed is:

1. A door stop, comprising:

a. a flexible bar having a first end, a second end, and six sequential adjacent bends between the first and second ends, the first bend closest to the first end, and the sixth bend closet to the second end;

b. a rubber grommet affixed into the first end, and protruding past the first end for contacting a wall; and c. a hole in the second end, the hole being substantially three-sixteenth inch in diameter for receiving a fastener;

wherein the distance between the fifth and sixth sequential adjacent bends is substantially equal to 1.375 inches for receiving a standard interior door.

2. The door stop according to claim 1, wherein the distance from the second end to a midpoint between the fourth and fifth sequential adjacent bends is slightly less than 1.375 inches.

3. The door stop according to claim 2, wherein the distance between the first and second sequential adjacent bends is substantially equal to the distance between the fifth and sixth sequential adjacent bends.

4. The door stop according to claim 3, wherein each of the first and sixth sequential adjacent bends is substantially ninety degrees, each of the third and fourth sequential adjacent bends is less than forty-five degrees, and the second sequential adjacent bend is greater than ninety degrees, but less than one hundred thirty-five degrees.

5. The door stop according to claim 4, wherein the distance from the first end to the second end is greater than four inches, and less than six inches.

6. The door stop according to claim 5, wherein the material of the flexible bar is chosen from the group consisting of iron, tin, aluminum, steel, stainless steel, and plastic.

7. A door stop, comprising:

a. a flexible bar having a first end, a second end, and six sequential adjacent bends between the first and second ends, the first bend closest to the first end, and the sixth bend closet to the second end;

b. a rubber grommet affixed into the first end, and protruding past the first end for contacting a wall; and c. a hole in the second end, the hole being substantially three-sixteenth inch in diameter for receiving a fastener;

wherein the distance between the fifth and sixth sequential adjacent bends is substantially equal to 1.75 inches for receiving a standard exterior door.

8. The door stop according to claim 7, wherein the distance from the second end to a midpoint between the fourth and fifth sequential adjacent bends is slightly less than 1.75 inches.

9. The door stop according to claim 8, wherein the distance between the first and second sequential adjacent bends is substantially equal to the distance between the fifth and sixth sequential adjacent bends.

10. The door stop according to claim 9, wherein each of the first and sixth sequential adjacent bends is substantially ninety degrees, each of the third and fourth sequential adjacent bends is less than forty-five degrees, and the second sequential adjacent bend is greater than ninety degrees, but less than one hundred thirty-five degrees.

11. The door stop according to claim 10, wherein the distance from the first end to the second end is greater than four inches, and less than six inches.

12. The door stop according to claim 11, wherein the material of the flexible bar is chosen from the group consisting of iron, tin, aluminum, steel, stainless steel, and plastic.

* * * * *